United States Patent [19]

Biffle

[11] 4,367,795

[45] Jan. 11, 1983

[54] ROTATING BLOWOUT PREVENTOR WITH IMPROVED SEAL ASSEMBLY

[76] Inventor: Morris S. Biffle, Rte. 3, Box 445-D, Midland, Tex. 79701

[21] Appl. No.: 202,688

[22] Filed: Oct. 31, 1980

[51] Int. Cl.[3] ..... E21B 33/03

[52] U.S. Cl. ..... 166/84; 166/88; 277/31; 277/188 A; 175/195

[58] Field of Search ..... 175/195, 209, 210; 166/82, 84, 88; 251/1 R, 1 A, 1 B; 277/188 A, 31

[56] References Cited

U.S. PATENT DOCUMENTS

| | | | |
|---|---|---|---|
| 2,192,805 | 3/1940 | Seamark | 277/31 |
| 3,096,096 | 7/1963 | Banks | 277/188 A |
| 3,387,851 | 6/1968 | Cugini | 277/31 X |
| 4,154,448 | 5/1979 | Biffle | 277/31 |

*Primary Examiner*—Ernest R. Purser
*Attorney, Agent, or Firm*—Marcus L. Bates

[57] ABSTRACT

A rotating blowout preventor having a rotating head to which a stripper assembly is attached. The stripper rubber of the stripper assembly has an axial passageway through which a rotating member is telescopingly received. The stripper rubber has an upper, conical face which downwardly slopes inwardly towards the axial passageway. The stripper assembly is mounted to an annular metal doughnut member having an axial passageway formed therethrough which is slightly larger in inside diameter as compared to the outside diameter of the rotating member extending along the axial centerline of the RBOP. The doughnut has a lower conical face which downwardly slopes inwardly towards the axial centerline of the RBOP, and which is placed closely adjacent to the upper conical face of the stripper rubber. This construction increases the working pressure of the RBOP for the reason that increased pressure differential across the stripper rubber causes the upper conical face of the rubber to slidably seat against the lower conical face of the doughnut, thereby precluding cold flow of rubber in an uphole direction. Reinforcements placed within the stripper rubber further increases the allowable pressure drop across the RBOP, as well as assisting the enlargement of the axial passageway as various rotating members are forced through the stripper rubber.

14 Claims, 6 Drawing Figures

ROTATING BLOWOUT PREVENTOR WITH IMPROVED SEAL ASSEMBLY

BACKGROUND OF THE INVENTION

In my previous U.S. Pat. Nos. 4,154,448 and 4,208,056, there is set forth a rotating blowout preventor which has a rotating external bearing housing formed at the upper marginal end thereof, and a special clamp assembly which enables the stripper rubber and mount means therefor to be lifted from the interior of the rotating head. In the above described RBOPs, as well as other known RBOPs, it is customary to fabricate the entire axial passageway of the RBOP as large as possible, except for the stripper rubber passageway, so as to enable the passage of large diameter tubular members therethrough. The stripper rubber axial passageway is made as small as possible so that the RBOP can sealingly engage the exterior surface of various different diameter rotating members.

When a pressure differential is effected across a prior art RBOP, the stripper rubber assembly is forced uphole into sealed engagement with the tubular member extending therethrough. As this pressure differential is increased, the uphole thrust against the stripper rubber will eventually tend to flow the rubber uphole through the annular area formed between the tubular member and the inside surfaces of the RBOP. This phenomenon is referred to as "cold flow". Therefore, in prior art RBOPs, a compromise must be made in selecting the cross-sectional area of the annulus formed between the rotating tubular member and the i.d. of the passageway formed through the RBOP.

In my above described patents, the stripper rubber along with the main mount member is easily removed from the rotating head assembly by unfastening a clamp at the upper extremity of the RBOP and lifting the stripper assembly in an upward direction. Therefore, the axial passageway formed through the RBOP can be made of the minimum size which will accommodate the tubular members passing therethrough. This improvement enables the stripper assembly to be lifted from the rotating head, thereby enabling joints of tubular goods to be made up or broken out while the stripper assembly remains attached to a medial marginal length of a kelly, for example.

It would be desirable to reduce the cross-sectional area of the annulus formed between the tubular member and the axial passageway of a RBOP so that cold flow of the stripper rubber assembly is reduced to a minimum. This is the subject of the present invention.

SUMMARY OF THE INVENTION

A high pressure rotating blowout preventor which withstands great pressure differentials across the stripper rubber thereof. The RBOP includes a main body having a rotating head assembly located at the upper marginal end thereof. The rotating head is supported from the main body by an external bearing chamber, and includes an internal stripper seal assembly removably affixed to and forming part of the rotating head assembly. The stripper seal assembly is comprised of a stripper mount member to which a stripper rubber is affixed. An axial passageway extends along the axial centerline of the stripper seal assembly and the main body for sealingly receiving a rotating member in a telescoping manner.

The stripper rubber includes an upper conical face which downwardly slopes towards the axial passageway. The stripper mount member includes a lower conical face made complementary respective to the conical face of the stripper rubber. The conical faces are placed adjacent to one another, with the axial passageway formed through the stripper mount member being of a minimum diameter required to receive a particular joint of the rotating member therethrough.

This combination of elements provides a minimum annular passageway between the RBOP and the rotating member which is rotatably and slidably received within the axial passageway. Accordingly, the present disclosure provides a RBOP which can be subjected to much higher pressures than has heretofore been possible because the stripper rubber seats against the stripper mount member, with there being a minimum axial passageway which must be sealed against flow.

Reinforcements vulcanized within the rubber increases the working pressure of the RBOP, and also facilitates the withdrawal of the rotating member therethrough.

A primary object of the present invention is the provision of a high pressure RBOP which precludes the cold flow of the stripper rubber material uphole therethrough.

Another object of the present invention is the provision of a RBOP having an axial passageway which receives a tool joint in sealed relationship therewithin in such a manner that the apparatus can withstand elevated pressure without cold flow of the stripper rubber occurring.

A further object of the present invention is the provision of a RBOP having an improved stripper seal assembly which seals the annulus between a rotating member and the annular passageway thereof in such a manner that the RBOP can endure extremely high pressures.

A still further object of the present invention is the provision of a RBOP having an improved rotating head assembly which sealingly engages a tool joint in an improved manner.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
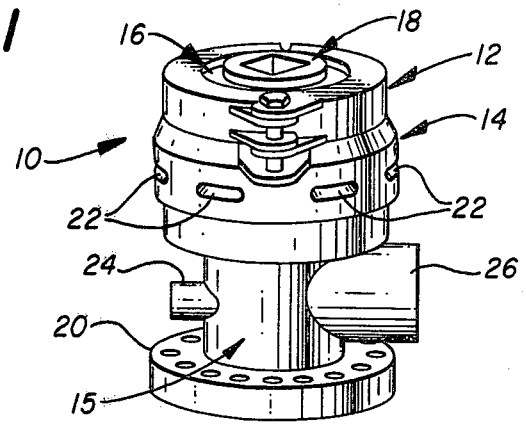
FIG. 1 is a perspective view of a RBOP made in accordance with the present invention.

In FIG. 1, there is disclosed a rotating blowout preventor, hereinafter called a RBOP, having external features made in accordance with U.S. Pat. No. 4,208,056 and U.S. Pat. No. 4,154,448. A clamp assembly 12 forms the upper terminal end of the apparatus. The upper marginal end of the apparatus is in the form of a rotating head assembly 14 which rotates respective to a main body 15. An adapter 16 enables a kelly bushing drive 18 to be removably received in fixed relationship respective to the rotating head.

A bolt flange 20 forms the lower terminal end of the RBOP. Radially spaced apart bleed outlets 22 are arranged in circumferentially extending relationship about a medial wall surface of the rotating head. A relatively small outlet 24 and a relatively large outlet 26 communicate the ambient with the upper borehole annulus.

Figure 2:
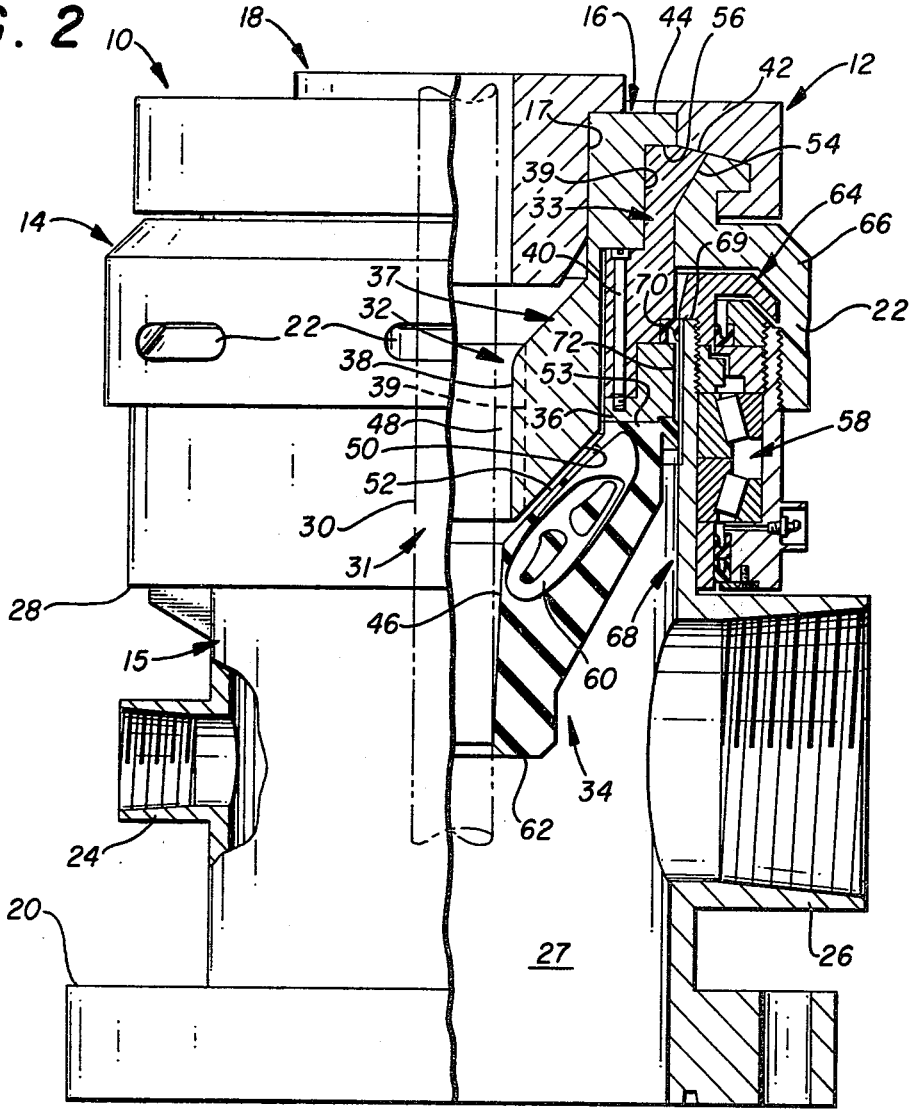
FIG. 2 is an enlarged, part cross-sectional, elevational view of the RBOP disclosed in FIG. 1.

In FIG. 2, the outlet is seen to be in communication with the upper borehole at 27, or with the borehole annulus. The rotating head terminates at lower edge portion 28 of a skirt member, the details of which are more fully set forth in the above mentioned patents. A rotating member 30, such as a kelly or a joint of drill tubing, is received through the illustrated axial passageway 31.

A stripper seal assembly 32, made in accordance with this invention, is removably seated within the rotating head. The assembly includes an upper mounting body 33 and a lower rubber stripper 34. The rubber stripper is vulcanized to a mount member 36, preferably an annular metal member of limited length.

The assembly 32 includes an annular metal wedge member 37, made in accordance with the present disclosure, having an axial passageway 38 formed therethrough. The passageway can be of any i.d. 39 which will accept member 30 therethrough. The member 36 is attached to mount member 33 by means of the illustrated circumferentially extending bolts 40. The upper terminal ends 42 and 44 of the mount member and wedge member form the upper terminal end of the stripper seal assembly. The upper marginal outer peripheral surface of the stripper seal assembly is contoured to be seated in close tolerance relationship respective to the upper marginal inner wall surfaces of the remainder of the rotating head assembly.

The rubber stripper has an i.d. 46 of a size to sealingly engage the exterior of the rotating member. The i.d. 38 of the wedge member is spaced from the rotating member to provide an annulus 48 therebetween. The i.d. 38 can be made of any value 39 required to accept the largest o.d. tool joint 30 received therethrough. This annulus is maintained at a minimum cross-sectional area for reasons which will be more fully appreciated later on as this disclosure is more fully digested.

The wedge member has a lower conical face 50 which downwardly slopes towards the longitudinal axial centerline of the axial passageway. The stripper rubber has an upper conical face 52 made complementary respective to the conical face 50 of the wedge member, and therefore downwardly slopes towards the axial passageway. Accordingly, the stripper rubber is attached at an outer annular area 53 and is abuttingly received in a slidable manner against the conical wedge face at an inner annular area 52.

Numeral 54 indicates the irregular innerface formed between the stripper seal assembly and the remainder of the rotating head assembly. The stripper mount member forms innerfaces 39 and 56 respective to the upper marginal end of the wedge member, while the kelly drive bushing forms an innerface 17 respective to the wedge member, with the innerfaces 17 and 39 being of an irregular configuration so that when the bushing is rotated by the kelly, rotational motion is imparted into the entire rotating head assembly.

The rotating head assembly is rotatably affixed to the main body by means of an external bearing housing 58, the details of which are more fully set forth in the above mentioned patents. A plurality of radially spaced apart reinforcing metal elements 60 are vulcanized within the stripper rubber for adding strength to the entire conical seating area 52 of the rubber. The stripper rubber has a lower terminal end 62.

Numeral 64 indicates the upper terminal end of the stationary main body, which is fixed respective to the rotating outer member 66, and which is supported from the upper end 69 of the washpipe 68. A rotating seal 70 seals the annulus 72 between the washpipe and the stripper assembly.

Figure 3:
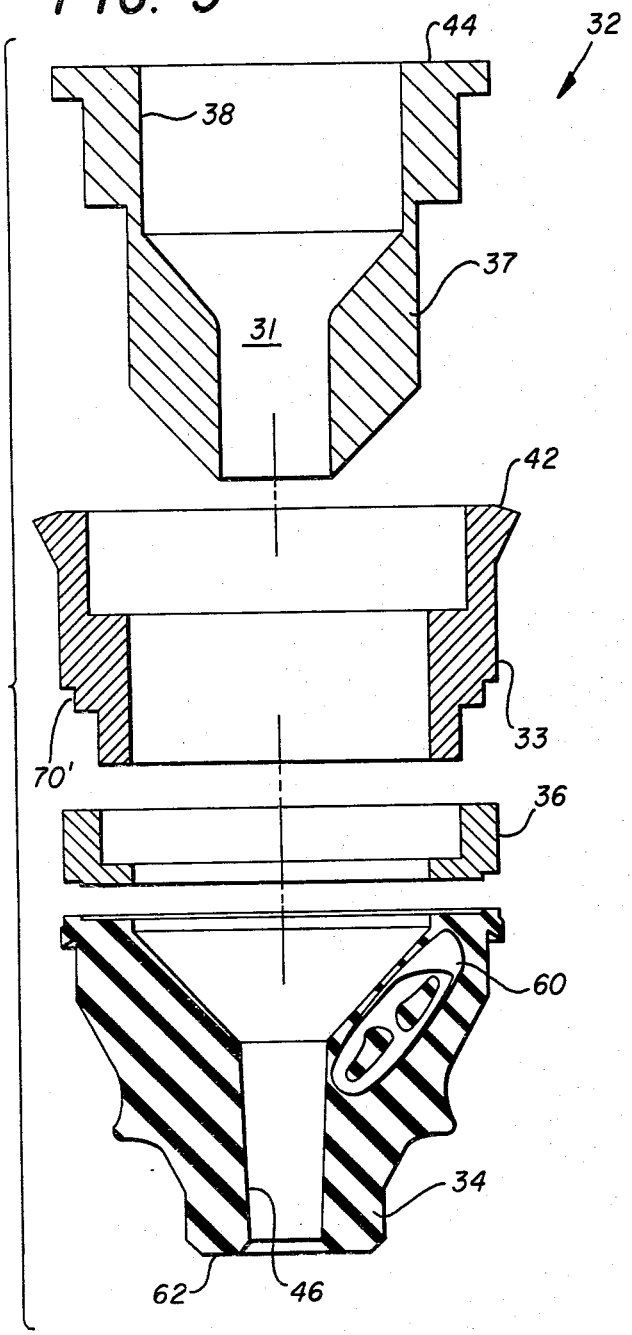
FIG. 3 is a reduced, longitudinal, cross-sectional view of part of the apparatus disclosed in FIG. 2.

In the embodiment set forth in FIG. 3, it will be noted that the stripper seal assembly has been removed from the rotating head assembly. The stripper seal assembly may include a kelly drive bushing, or the inner surface area 38 can be made of irregular configuration and complementary respective to the cross-sectional configuration of the kelly.

Figure 4:
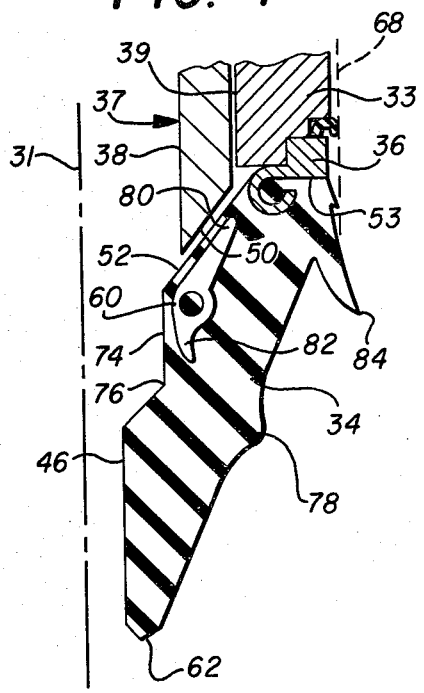
FIG. 4 is an enlarged, cross-sectional view of a modified form of the invention set forth in FIG. 3.

In FIG. 4, the wedge member 37 is telescoped into operative position within the mounting body 33. The rubber stripper includes a vertical wall 74 set inwardly of wall 38 and outwardly of wall 46 for more easily accommodating the kelly. The rubber is inwardly inclined at 76 where the rubber reduces to form passageway 46. Outwardly directed enlargement 78 is opposed to reduced area 76 for reinforcing the rubber structure.

The element 60 includes a marginal length 80 having a surface formed thereon which is arranged parallel to the conical wall surface 52, and a marginal length 82 having a surface arranged parallel to the vertical wall surface 74. Debris barrier 84 rotates against the washpipe and prevents debris from entering annulus 72.

Figure 5:
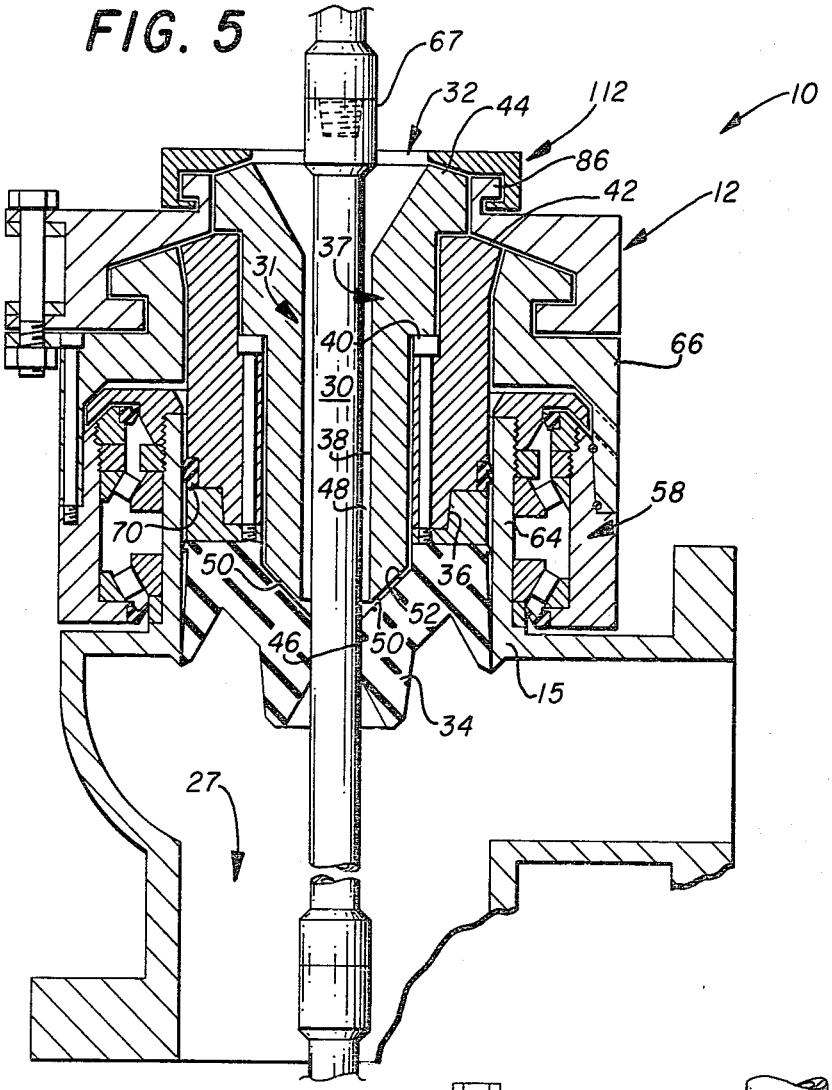
FIG. 5 is a part diagrammatical, part schematical, part cross-sectional view of another embodiment of the apparatus disclosed in FIGS. 1 and 2; and, FIG. 6 is a prior art RBOP which has been subjected to excessive working pressure.

FIG. 5 diagrammatically sets forth a RBOP made in accordance with the present invention. As seen in FIG. 5, a rotating member in the form of a tool joint 30 extends through the axial passageway of the RBOP. The stripper seal assembly is removably seated in fixed relationship respective to the rotating head, and therefore rotates respective to the main body. The conical faces 50 and 52 of the metal wedge member and the rubber abuttingly engage one another, while the outer peripheral area of the rubber and wedge member are attached to one another at 36.

A second clamp 112 engages a circumferentially extending lip 86 to fasten the upper end 44 of the wedge member to the upper end 42 of the mounting body, thereby securing the entire stripper assembly to the rotating head.

The annulus 48 is made of the minimum cross-sectional area which is consistent with the o.d. of the rotating member 30 which must pass through the passageway 44 of the rubber and passageway 46 of the metal wedge member.

Figure 6:
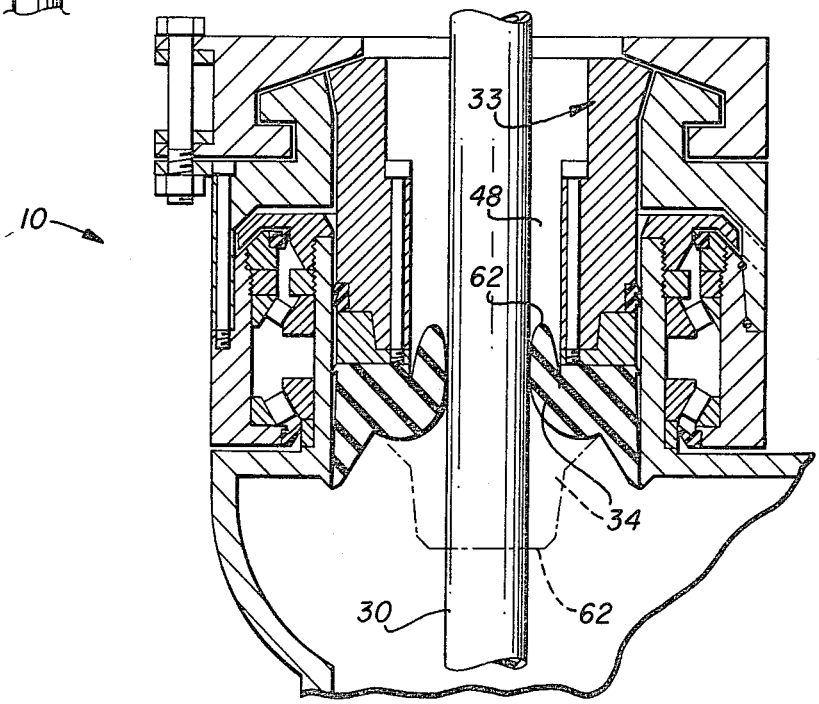
FIG. 6 PRIOR ART

In FIG. 6, there is disclosed a prior art RBOP having a rubber 34 which has been subjected to an excessive pressure drop thereacross. The lower end 62 of the rubber has cold flowed up the annulus 48 between the members 30 and 33. This is a dangerous condition because the RBOP has lost control of the well which has "blown out".

In operation of the present invention, the metal reinforcements 60 greatly enhance the uphole passage of member 30 through the rubber stripper. As the enlarged or upset ends 67 of the tool joint pass axially through the rubber stripper, the reinforcing elements are forced upward and outward. This action urges the sides of the passageway radially outward, thereby facilitating stripping out the tool joints.

The wedge can be changed during the drilling operation to accommodate various size drill strings or kellys. Where high pressure formations are being penetrated and the drill string size must be changed, the hydrill (annular blowout preventor) located below the RBOP is set, thereby containing the hydrostatic pressure. The wedge can now be changed by picking up the stripper assembly so that it is at the level of the turn table, or alternatively, by picking up only the wedge and replacing it with the desired alternant wedge size.

For example, when removing a $5\frac{1}{4}''$ diameter drill string from the hole, a wedge having a 5-5/16" diameter central passageway is advantageously employed. Should the string increase to $6\frac{1}{4}''$, the wedge i.d. is changed to $6\frac{5}{8}''$ diameter.

Therefore, as the tool joint reduces or increases in diameter, the wedge is changed as the string is coming out or going into the hole.

The reduced area of annulus 48 together with the reinforcing elements 60 and the action of the conical faces 50 and 52 provide a new combination which greatly increases the working pressure of a RBOP.

I claim:

1. A rotating blowout preventor having a main body, a longitudinal extending axial passageway formed therethrough through which a driving member can be received; said main body includes a lateral outlet in communication with the lower end of said axial passageway; means for removably mounting said main body to the upper end of a cased borehole; a rotating head assembly received within said axial passageway which forms the upper marginal end of said rotating blowout preventor;

a stripper assembly which includes a stripper rubber for sealingly receiving a longitudinally extending driving member in axial slidable relationship therewith; a stripper mount body to which said stripper rubber is affixed, an outer marginal length of said stripper assembly being of a configuration to be supportedly received in a removable manner within said rotating head assembly; seal means located between said stripper mount body and said axial passageway for precluding flow of drilling fluid therebetween;

an insert axially received within said stripper mount body, said insert includes a lower wedge face which is of conical configuration and which downwardly and inwardly slopes towards the axial passageway; said stripper rubber includes an upper conical face made complementary respective to said wedge face; said conical face of said stripper rubber abuttingly engages said wedge face;

an axial passageway formed through said stripper assembly which is concentrically arranged respective to the first said axial passageway;

and means associated with said stripper assembly for enabling a driving member to impart rotational motion thereinto which causes said rotating head and stripper assembly to rotate.

2. The rotating blowout preventor of claim 1 wherein said stripper rubber includes a plurality of radially spaced reinforcing elements vulcanized therewithin, said elements have an upper surface which extends radially away from the axial centerline of the axial passageway and in spaced relation respective to the lower wedge face of the stripper mount body.

3. The rotating blowout preventor of claim 2 wherein said insert is an annular body having an axial passageway formed therethrough, and an outer circumferentially extending surface which is received within said stripper mount body, so that inserts of various different diameters can be placed within the stripper mount body to enable the diameter of the last said axial passageway to be changed to accommodate different sizes of driving members.

4. The rotating blowout preventor of claim 3 wherein said rotating head assembly includes clamp means by which said stripper mount body is removably affixed thereto.

5. The rotating blowout preventor of claim 4 wherein said insert includes fastener means by which said insert is removably affixed to said rotating head.

6. The rotating blowout preventor of claim 1 wherein said insert is of annular construction and includes a longitudinal axial passageway formed therethrough, and an outer circumferentially extending surface which is of a size to be received within said stripper mount body, so that various different ones of said inserts can be placed within the stripper mount body to enable the diameter of the last said passageway to be changed to accommodate the driving member;

said rotating head assembly includes clamp means by which said stripper mount body is removably affixed thereto; said insert includes fastener means by which it is removably affixed to said rotating head assembly.

7. In a blowout preventor of the type having a main body, and a longitudinal extending axial passageway formed therethrough through which a tool joint can be received; the combination with said main body of a stripper assembly;

said stripper assembly includes a stripper rubber for sealingly receiving a longitudinally extending member in axial slidable relationship therewith; a stripper mount body to which said stripper rubber is affixed, the lower marginal end of said stripper assembly being received within the upper marginal end of said main body, seal means located between said stripper mount body and said main body for precluding flow of drilling fluid therebetween;

the lower end of said stripper mount body includes an outer annular area attached to an upper outer annular area formed on said stripper rubber; said stripper mount body includes an inner annular area which is conical in configuration at the lower end thereof to present an annular wedge which downwardly and inwardly slopes towards the axial centerline of the passageway;

an inner annular area of the upper end of said stripper rubber is made complementary respective to the lower surface of said annular wedge for slidably engaging one conical surface with the other;

so that the annulus formed between the tool joint and the stripper assembly may be reduced to a minimum, and the pressure drop across the stripper assembly seats the upper conical face of the stripper rubber against the lower conical face of the stripper mount member.

8. The rotating blowout preventor of claim 7 wherein said stripper rubber includes a plurality of radially spaced reinforcing elements vulcanized therewithin, said elements have an upper surface which extends radially away from the axial centerline of the axial passageway and in spaced relation respective to the lower wedge face of the stripper mount body.

9. The rotating blowout prevent of claim 8 wherein said lower wedge face is formed on the lower end portion of an insert which is removably affixed to and forms part of said stripper mount body;

said insert is an annular body having an axial passageway formed therethrough, and an outer circumferentially extending surface which is received within said stripper mount body, so that inserts of various different diameters can be placed within the stripper mount body to enable the diameter of the last said axial passageway to be changed to accommodate different sizes of driving members.

10. The rotating blowout preventor of claim 9 wherein said rotating head assembly includes clamp means by which said stripper mount body is removably affixed thereto.

11. The rotating blowout preventor of claim 10 wherein said insert includes fastener means by which said insert is removably affixed to said rotating head.

12. The rotating blowout preventor of claim 7 wherein said lower wedge face is formed on the lower end portion of an insert which is removably affixed to said stripper mount body;

said insert is an annular body having a longitudinal axial passageway formed therethrough, and an outer circumferentially extending surface which is of a size to be received within said stripper mount body, so that various different ones of said inserts can be placed within the stripper mount body to enable the diameter of the last said passageway to be changed to accommodate the driving member;

said rotating head assembly includes clamp means by which said stripper mount body is removably affixed thereto; said insert includes fastener means by which it is removably affixed to said rotating head assembly.

13. A rotating blowout preventor having a main body member, a rotating head assembly, and an external bearing chamber having bearing means isolated therein for rotatable supporting said head assembly;

said rotating head assembly includes a stripper assembly which is removably received therewithin;

said main body member includes an upwardly extending fixed washpipe which supports said bearing chamber externally thereof, and which receives said stripper assembly therewithin;

an outflow pipe attached to said main body in underlying relationship respective to said rotating head assembly and arranged for flow to occur laterally therefrom;

the inner wall of said bearing chamber is the outer wall of said washpipe;

said stripper assembly includes a stripper rubber for sealingly receiving a longitudinally extending driving member in axial slidable relationship therewith; a stripper mount body to which said stripper rubber is affixed, an outer marginal length of said stripper assembly being of a configuration to be supportedly received in a removable manner within said rotating head assembly; seal means located between said stripper mount body and said washpipe for precluding flow of drilling fluid therebetween;

said stripper mount body includes an annular member having a lower wedge face which is of conical configuration and which downwardly and inwardly slopes towards the axial passageway; said stripper rubber includes an upper conical face made complementary respective to said wedge face; said conical face of said stripper rubber abuttingly engages said wedge face;

and means associated with said stripper assembly for enabling a driving member to impart rotational motion thereinto which causes said rotating head and stripper assembly to rotate.

14. The rotating blowout preventor of claim 13 wherein said lower wedge face is formed on the lower end portion of an insert which is removably affixed to said stripper mount body;

said insert is an annular body having a longitudinal axial passageway formed therethrough, and an outer circumferentially extending surface which is of a size to be received within said stripper mount body, so that various different ones of said inserts can be placed within the stripper mount body to enable the diameter of the last said passageway to be changed to accommodate the driving member;

said rotating head assembly includes clamp means by which said stripper mount body is removably affixed thereto; said insert includes fastener means by which it is removably affixed to said rotating head assembly.

* * * * *